US007726534B2

(12) United States Patent
Chou et al.

(10) Patent No.: US 7,726,534 B2
(45) Date of Patent: Jun. 1, 2010

(54) MAGAZINE FOR A NAIL-DRIVING POWERED TOOL

(76) Inventors: Kun-Chuan Chou, No. 3, Alley 2, Lane 214, Pengyi Rd., Taiping City, Taichung County (TW) 41174; Chi-Cheng Chou, No. 3, Alley 2, Lane 214, Pengyi Rd., Taiping City, Taichung County (TW) 41174

( * ) Notice: Subject to any disclaimer, the term of this patent is extended or adjusted under 35 U.S.C. 154(b) by 78 days.

(21) Appl. No.: 12/051,354

(22) Filed: Mar. 19, 2008

(65) Prior Publication Data

US 2008/0251565 A1 Oct. 16, 2008

(51) Int. Cl.
*B25C 1/16* (2006.01)

(52) U.S. Cl. ..... 227/120; 227/109; 227/130

(58) Field of Classification Search ..... 227/109, 227/120, 132, 113, 116, 130; 206/338
See application file for complete search history.

(56) References Cited

U.S. PATENT DOCUMENTS 3,437,249 A * 4/1969 Baum ..... 227/120
5,653,371 A * 8/1997 Hou ..... 227/109
5,934,539 A * 8/1999 Lee ..... 227/109
6,564,985 B1 * 5/2003 Chou ..... 227/109
6,837,414 B1 * 1/2005 Chou ..... 227/109
7,163,135 B1 * 1/2007 Huang ..... 227/109

* cited by examiner

*Primary Examiner*—Rinaldi I. Rada
*Assistant Examiner*—Nathaniel Chukwurah
(74) *Attorney, Agent, or Firm*—Shook, Hardy & Bacon L.L.P

(57) ABSTRACT

A magazine includes a feeding tray having a nail path to allow passage of one nail strip and a loading space in spatial communication with the nail path and that is adapted for accommodating a plurality of stacked nail strips, a tray cover coupled to the feeding tray, and a first pusher unit connected detachably to the feeding tray and adapted to press against an uppermost one of the nail strips so as to push a lowermost one of the nail strips into the nail path, and a second pusher unit. When the lowermost one of the nail strips is moved into the nail path, it is pushed toward the nail outlet by the second pusher unit. The tray cover is slidable to uncover at least one of the nail path, thereby permitting an additional nail strip to be placed into the nail path.

4 Claims, 7 Drawing Sheets

MAGAZINE FOR A NAIL-DRIVING POWERED TOOL

BACKGROUND OF THE INVENTION

1. Field of the Invention

The invention relates to a magazine for a powered nail-driving tool, more particularly to a magazine capable of accommodating a plurality of stacked nail strips.

2. Description of the Related Art

U.S. Pat. No. 6,837,414 B1 discloses a conventional magazine for a nail-driving power tool. The conventional magazine includes a separating member interposed between a stacking opening in a nail-supplying member and a standby zone of a feeding tray, and having a plurality of keyways that extend in a longitudinal direction. The conventional magazine further includes a gate member having a plurality of keys. The keys are are slidable along the keyways, respectively, such that the separating member is movable with the gate member relative to the nail-supplying member in the longitudinal direction. In use, an operating block is operable to pull the gate member to move along a retracting course, and then the gate member is pulled along with the separating member away from the stacking opening.

However, the manufacturing process of the keyways in the gate member is relatively complicated. Besides, foreign particles, such as metal debris, may accumulate between the separating member and the gate member, thereby obstructing the movement of the operating block. Moreover, when the operating block is pulled, a force is required to overcome the biasing force of springs so as to move the gate member. Afterward, a larger force is required for moving the gate member along with the separating member away from the stacking opening, thereby resulting in inconvenience during use. Furthermore, when the operating block is released, it is relatively difficult for the gate member as well as the separating member to separate accurately a lowermost layer of nails from the remaining layers of nails. In addition, when it is desired to load only one nail strip, it is still necessary to load the same via the stacking opening, which results in a troublesome process.

SUMMARY OF THE INVENTION

Therefore, the object of the present invention is to provide a magazine that is capable of being loaded selectively with a plurality of stacked nail strips or one nail strip at one time, that is easy to be manufactured and operated, and that can separating accurately the nails of the nail strip therein for ejection.

Accordingly, a magazine of the present invention is adapted for accommodating a plurality of stacked nail strips, each of which has a nail tip portion. The magazine comprises a feeding tray, a tray cover, and first and second pusher units. The feeding tray has a nail outlet that is formed at one end thereof, opposite first and second side surfaces, a nail path that is formed in the first side surface and that is sized to allow passage of only one of the nail strips therethrough at a time, and a loading space that extends therethrough in a transverse direction transverse to the nail path, that has a lower end in spatial communication with the nail path, and that is adapted for accommodating the nail strips. The tray cover is coupled slidably to the feeding tray and is movable relative to the feeding tray between a covering position, where the nail path is covered by the tray cover, and an uncovering position, where the nail path is not covered by the tray cover. The first pusher unit is connected detachably to the feeding tray for covering an end of the loading space opposite to the nail path, and is detachable from the feeding tray so as to allow the nail strips to be loaded into the loading space. The first pusher unit includes a first push plate that is adapted to be biased to press downwardly against the nail tip portion of an uppermost one of the nail strips so as to push the nail strips toward the nail path in the transverse direction so that a lowermost one of the nail strips is movable into the nail path. The second pusher unit is disposed between the feeding tray and the tray cover, and includes at least one second push plate that is adapted to be biased to push the lowermost one of the nail strips toward the nail outlet when the lowermost one of the nail strips is disposed in the nail path, and a separating member that is secured to the tray cover, that extends parallel to the nail path, and that is movable along with the tray cover between a separating position, where the tray cover is disposed at the covering position and where movement of the lowermost one of the nail strips from the loading space into the nail path is prevented, and a non-separating position, where the tray cover is disposed at the uncovering position and where movement of the lowermost one of the nail strips from the loading space into the nail path is allowed. The tray cover is slidable relative to the feeding tray so as to uncover at least one portion of the nail path, thereby permitting an additional nail strip to be placed into the nail path, after which the tray cover is movable to the covering position so that the second push plate contacts and pushes the additional nail strip toward the nail outlet.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
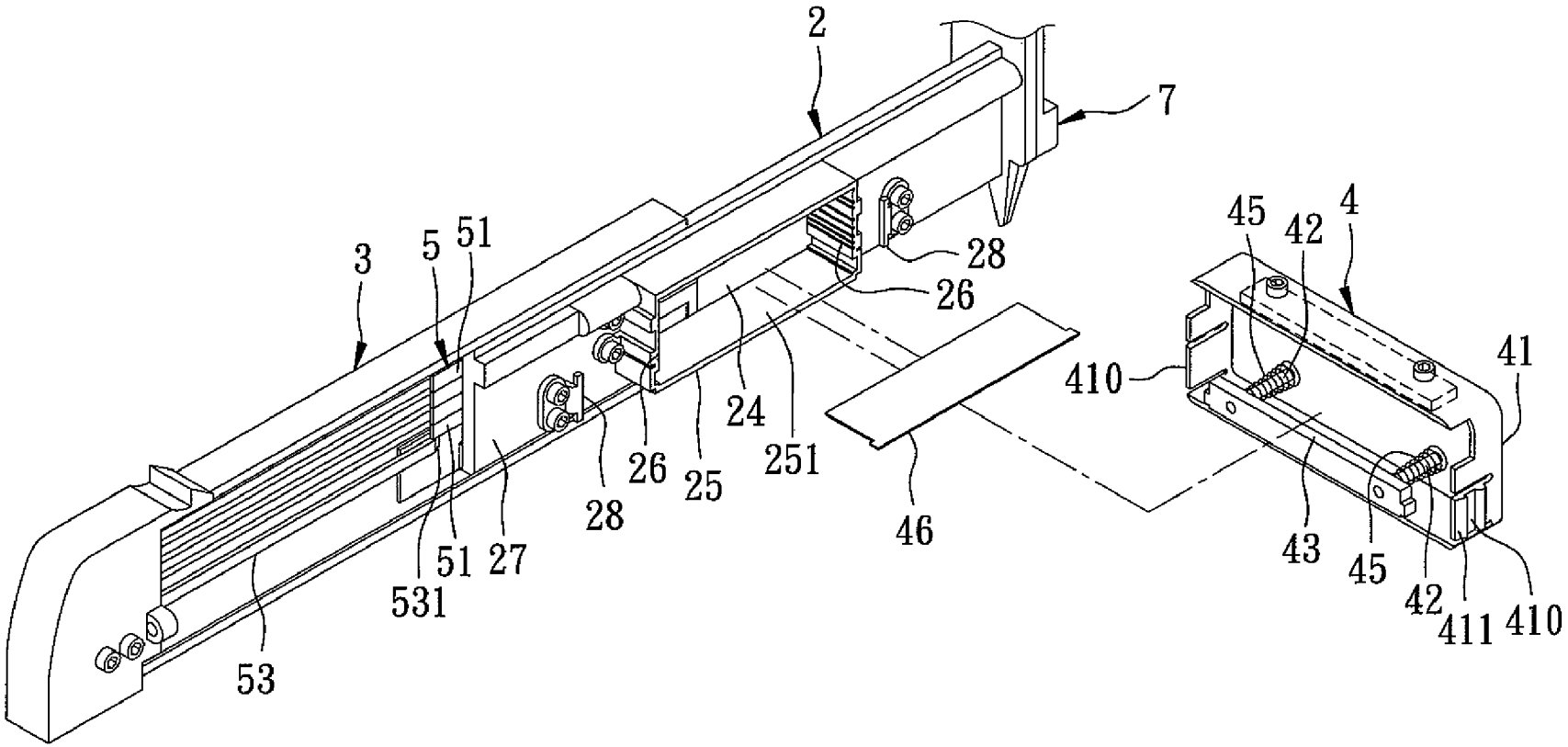
FIG. 1 is a partly exploded perspective view of a preferred embodiment of a magazine according to the invention.
Figure 2:
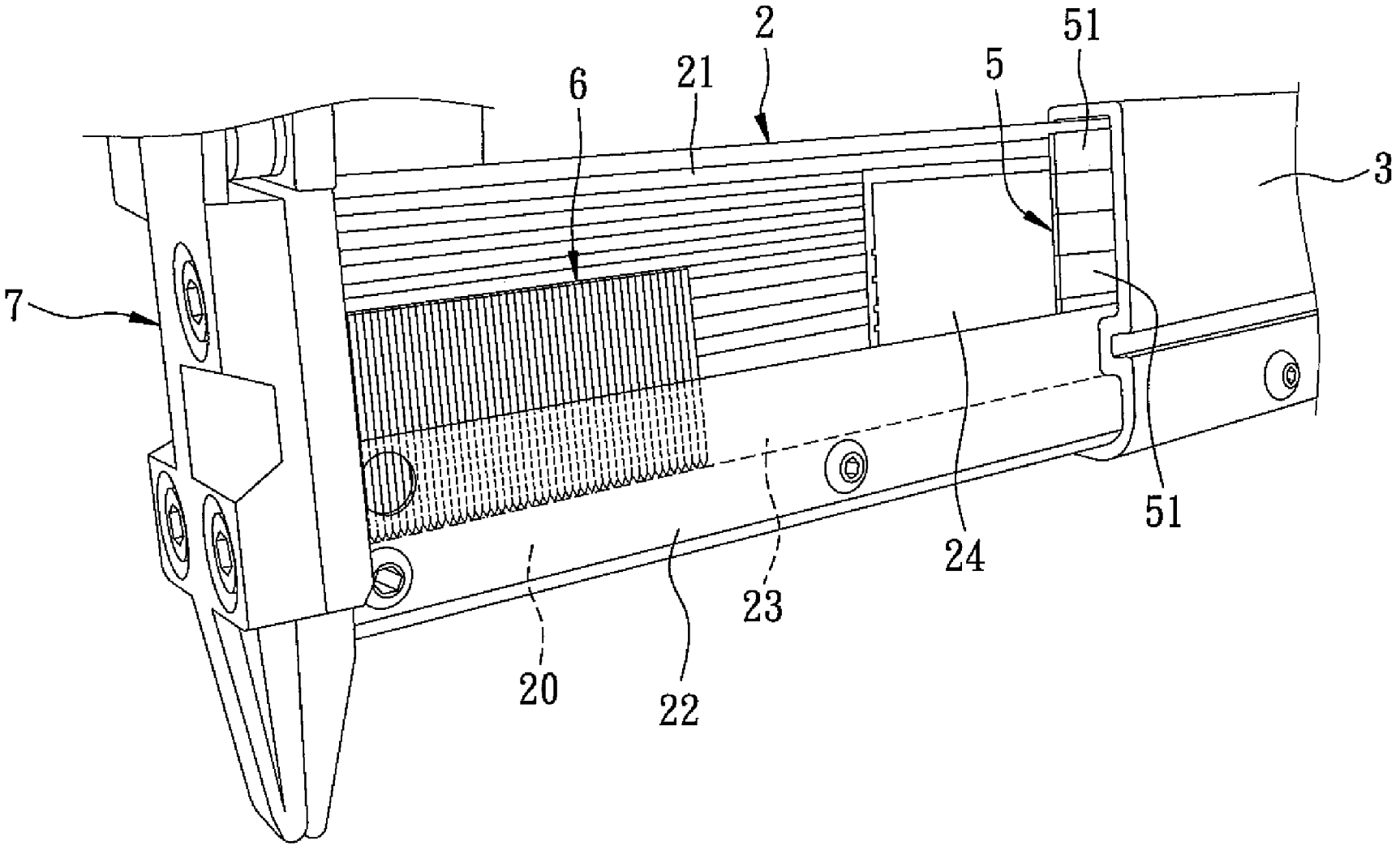
FIG. 2 is a fragmentary assembled perspective view of the preferred embodiment.
Figure 3:
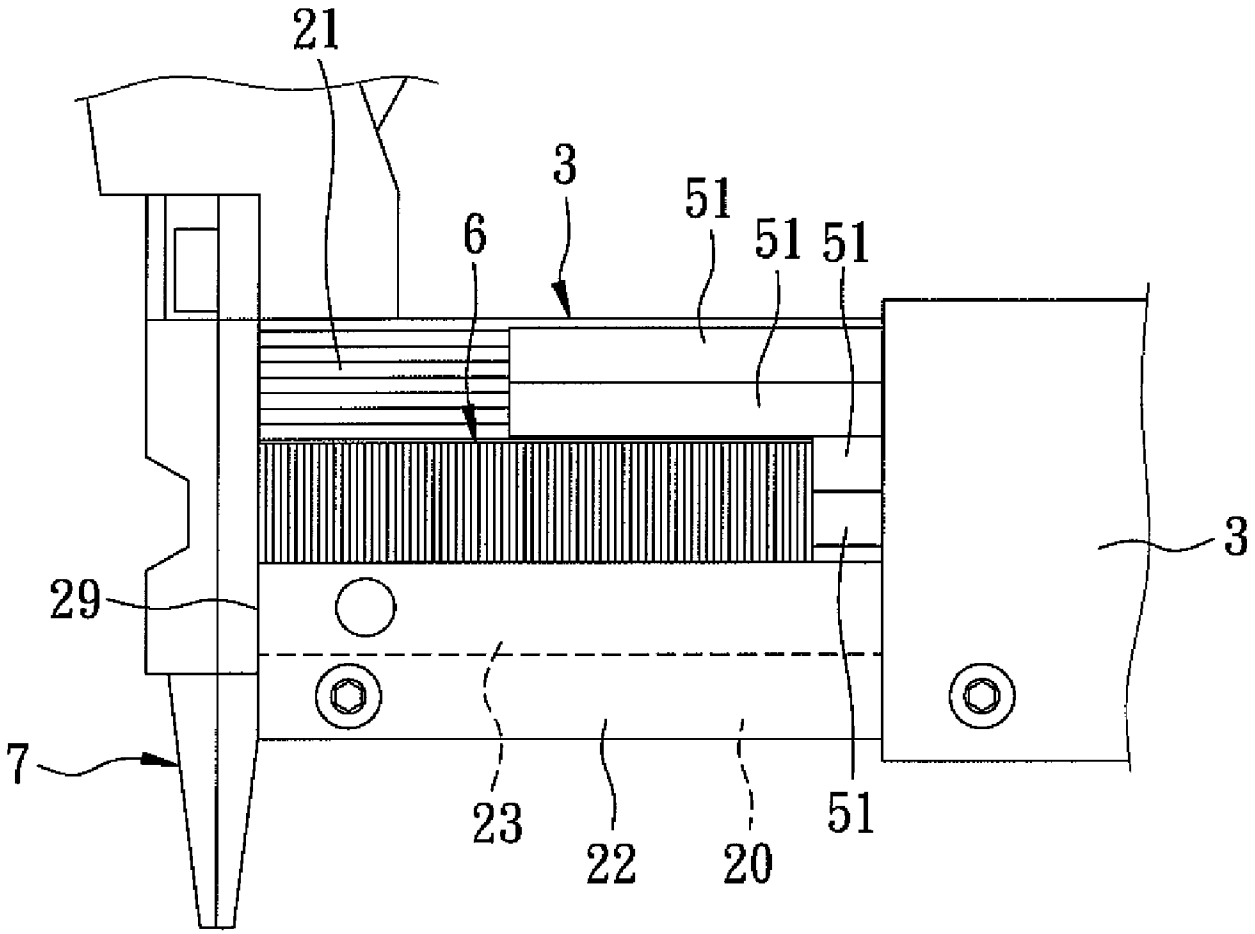
FIG. 3 is a fragmentary assembled side view of the preferred embodiment.

As shown in FIGS. 1 to 3, the preferred embodiment of a magazine according to the present invention is adapted for use with a nail-driving power tool, and is adapted for accommodating a plurality of stacked nail strips 6. The magazine includes a feeding tray 2, a tray cover 3, and first and second pusher units 4, 5.

The feeding tray 2 has a nail outlet 29 in spatial communication with a nail passage (not shown) in a nail feeding seat 7 of the nail-driving power tool, a first side surface 21, a fill block 20 disposed fixedly on the first side surface 21, a nail-limiting plate 22 secured on the fill block 20 and disposed parallel to the first side surface 21 to define a nail path 23 between the nail-limiting plate 22 and the first side surface 21, and a second side surface 27 opposite to the first side surface 21. The nail path 23 is sized to allow passage of only one nail strip 6 therethrough at a time. The feeding tray 2 is formed with a surrounding wall 25 defining a loading space 24 that extends through the feeding tray 2 in a transverse direction transverse to the nail path 23, that has a lower end in spatial communication with the nail path 23, and that is adapted for accommodating a plurality of nail strips 6. The surrounding wall 25 has an inner wall surface 251 formed with a plurality of opposed pairs of insert grooves 26. The feeding tray 2 is further formed with a pair of curved plates 28 at the second side surface 27 thereof that flank the loading space 24, and that extend from the second side surface 27 toward each other.

Figure 6:
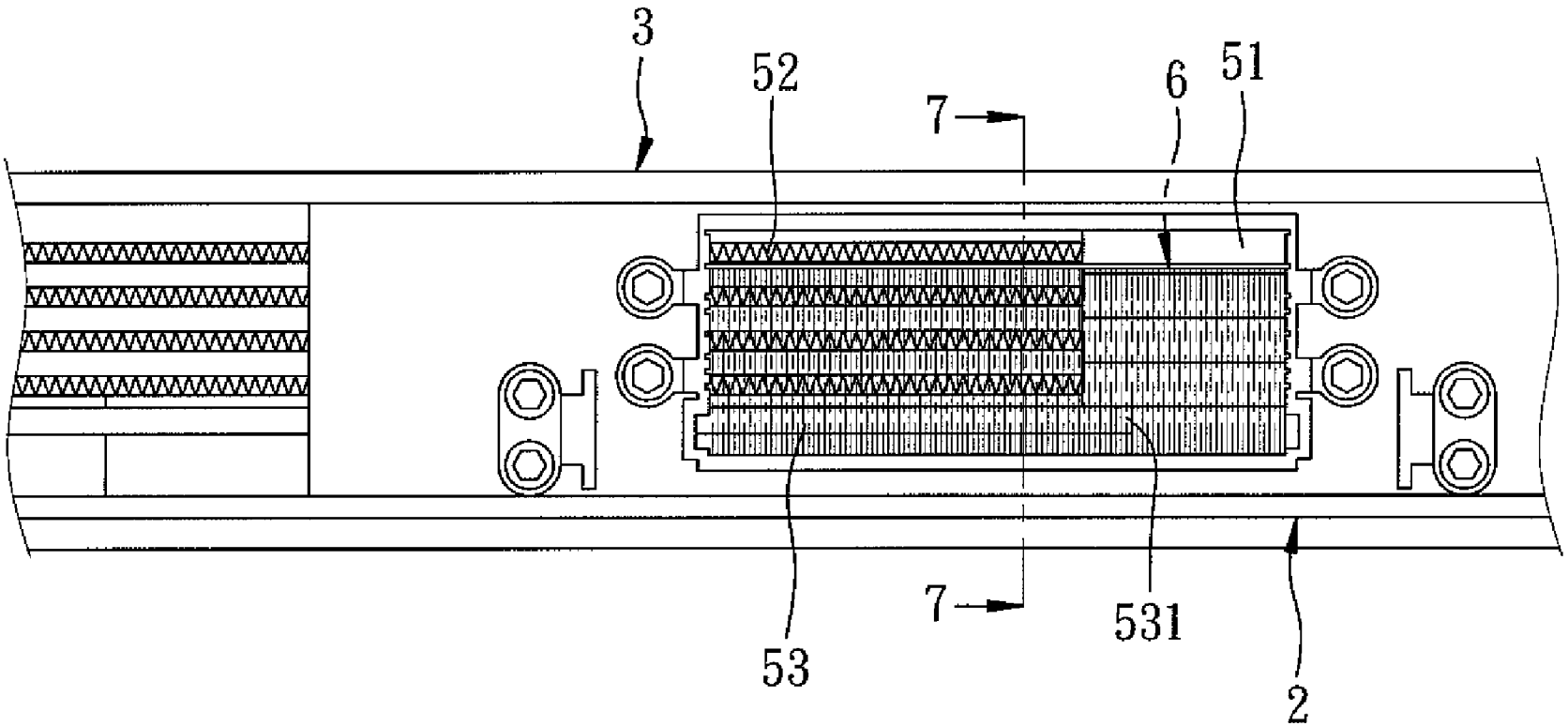
FIG. 6 is a view similar to FIG. 4, but illustrating the tray cover at a covering position.
Figure 7:
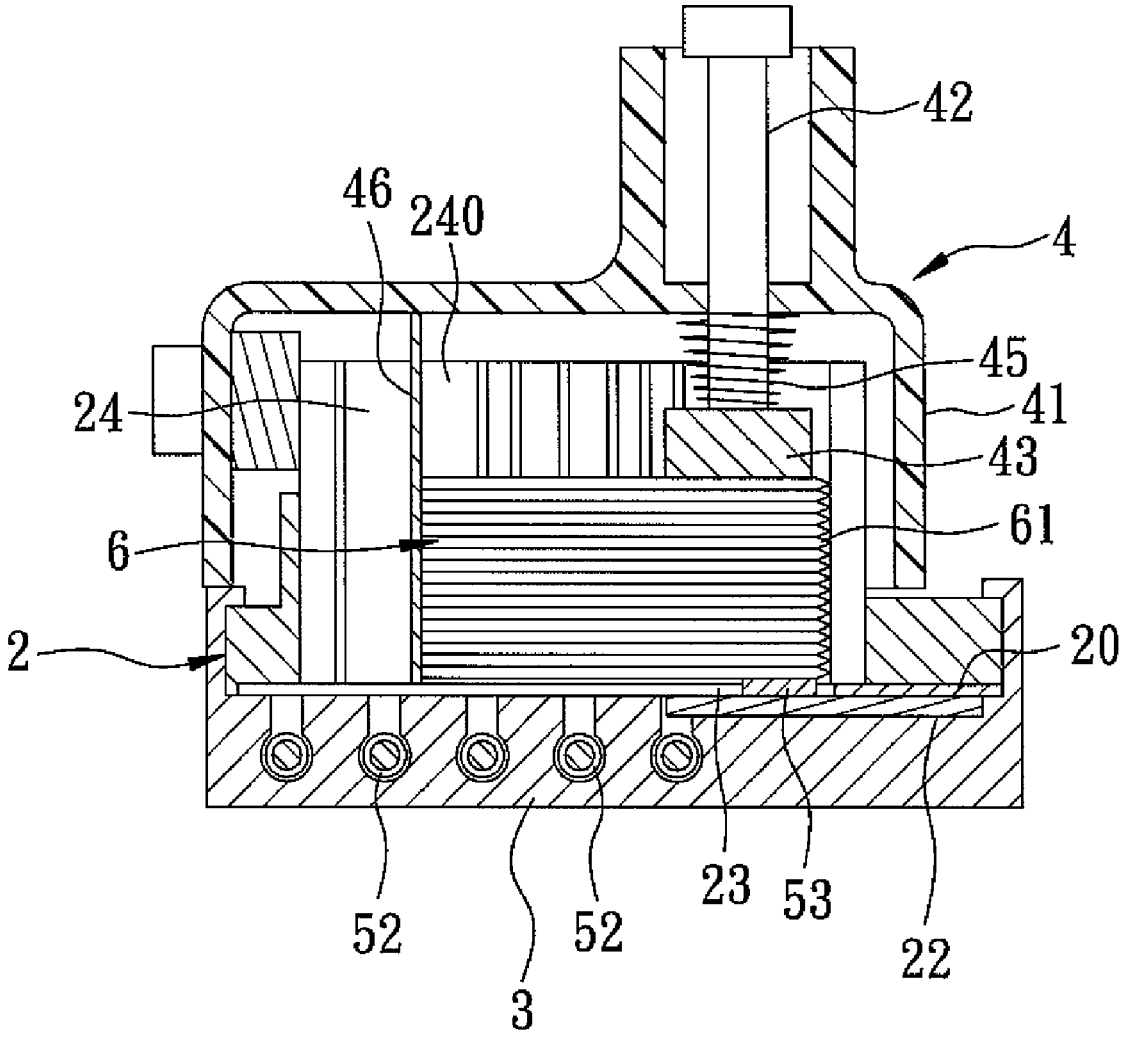
FIG. 7 is another sectional view of the preferred embodiment taken along line 7-7 in FIG. 6.

The tray cover 3 is coupled slidably to the feeding tray 2 and is movable relative to the feeding tray 2 between a covering position (see FIGS. 6 and 7), where the nail path 23 is covered by the tray cover 3, and an uncovering position (see FIGS. 4 and 5), where the nail path 23 is not covered by the tray cover 3.

In this embodiment, the first pusher unit 4 includes a first push plate 43 and a plate seat 41 coupled detachably to the feeding tray 2 for covering an end of the loading space 24 in the feeding tray 2 opposite to the nail path 23. The first pusher unit 4 further includes a pair of rods 42 extending perpendicularly and respectively from the first push plate 43 through the plate seat 41, and a pair of biasing components 45 configured as coil compression springs, disposed between the first push plate 43 and the plate seat 41, and sleeved respectively on the rods 42. The plate seat 41 includes two opposite resilient plates 410, and two barbed assembling components 411 disposed respectively on outer surfaces of the resilient plates 410. The curved plates 28 of the feeding tray 2 engage respectively and detachably the assembling component 411 for coupling the plate seat 41 and the feeding tray 2 together. The first pusher unit 4 further includes a partition 46 that is inserted removably into a selected one pair of the insert grooves 26 in the surrounding wall 25 of the feeding tray 2.

The second pusher unit 5 is disposed between the feeding tray 2 and the tray cover 3. In this embodiment, the second pusher unit 5 includes a plurality of juxtaposed second push plates 51 extending parallel to the nail path 23 of the feeding tray 2, each of which is movable toward or away from the nail outlet 29. The second pusher unit 5 further includes a plurality of spring components 52 disposed between the second push plates 51 and the tray cover 3 (see FIG. 6), and a separating member 53 secured to the tray cover 3 and extending parallel to the nail path 23. The separating member 53 is configured as a plate, and has a tapered end 531.

As shown in FIGS. 2 and 3, the tray cover 3 is operable to slide along with the second pusher unit 5 relative to the feeding tray 2 so as to uncover one portion of the nail path 23, thereby permitting a nail strip 6 to be placed into the nail path 23, after which the tray cover 3 is movable to the covering position so that the second push plates 51 are biased respectively by the spring components 52 to contact and push the nail strip 6 toward the nail outlet 29. Due to different lengths of the nails, when the tray cover 3 is moved from the uncovering position to the covering position, some of the second push plates 51 are biased to push the nail strips 6 as a result of a compressed state of the corresponding spring components 52, while the remaining second push plates 51 cooperate with the nail path 23 to position the nail strip 6 within the nail path 23 as a result of a non-compressed state of the corresponding components 52 during the movement of the nail trip 6 (see FIG. 3).

Figure 5:
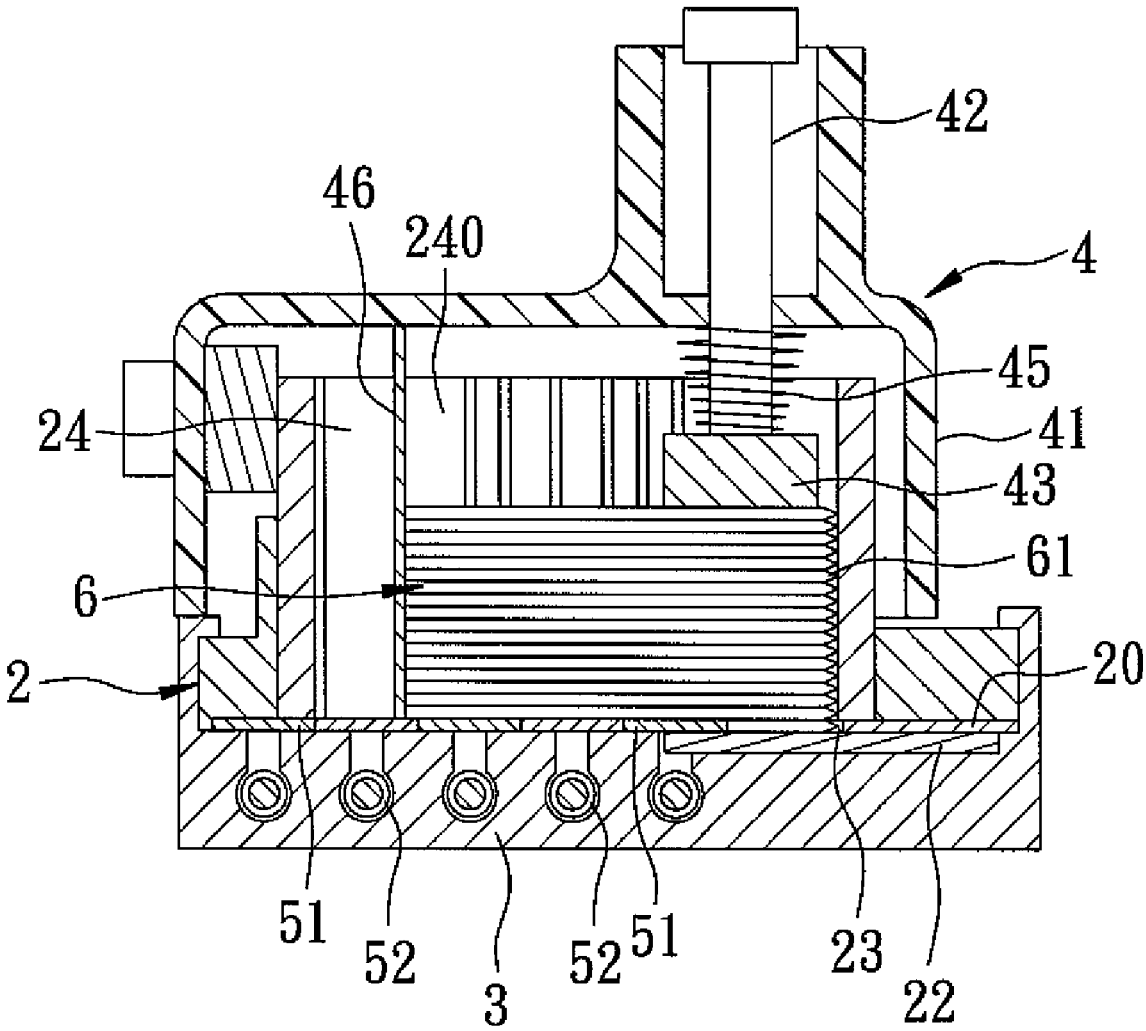
FIG. 5 is a sectional view of the preferred embodiment taken along line 5-5 in FIG. 4.

As shown in FIGS. 1 and 5, the first pusher unit 4 is detachable from the feeding tray 2 so as to allow the stacked nail strips 6 to be loaded into the loading space 24 in the feeding tray 2. Since the insert grooves 26 in the surrounding wall 25 of the feeding tray 2 are located at different height positions, the partition 46 of the first pusher unit 4 can be inserted into one pair of the insert grooves 26 to define a strip-receiving space portion 240 such that the nail strips 6 are accommodating fittingly within the strip-receiving space portion 240.

Figure 4:
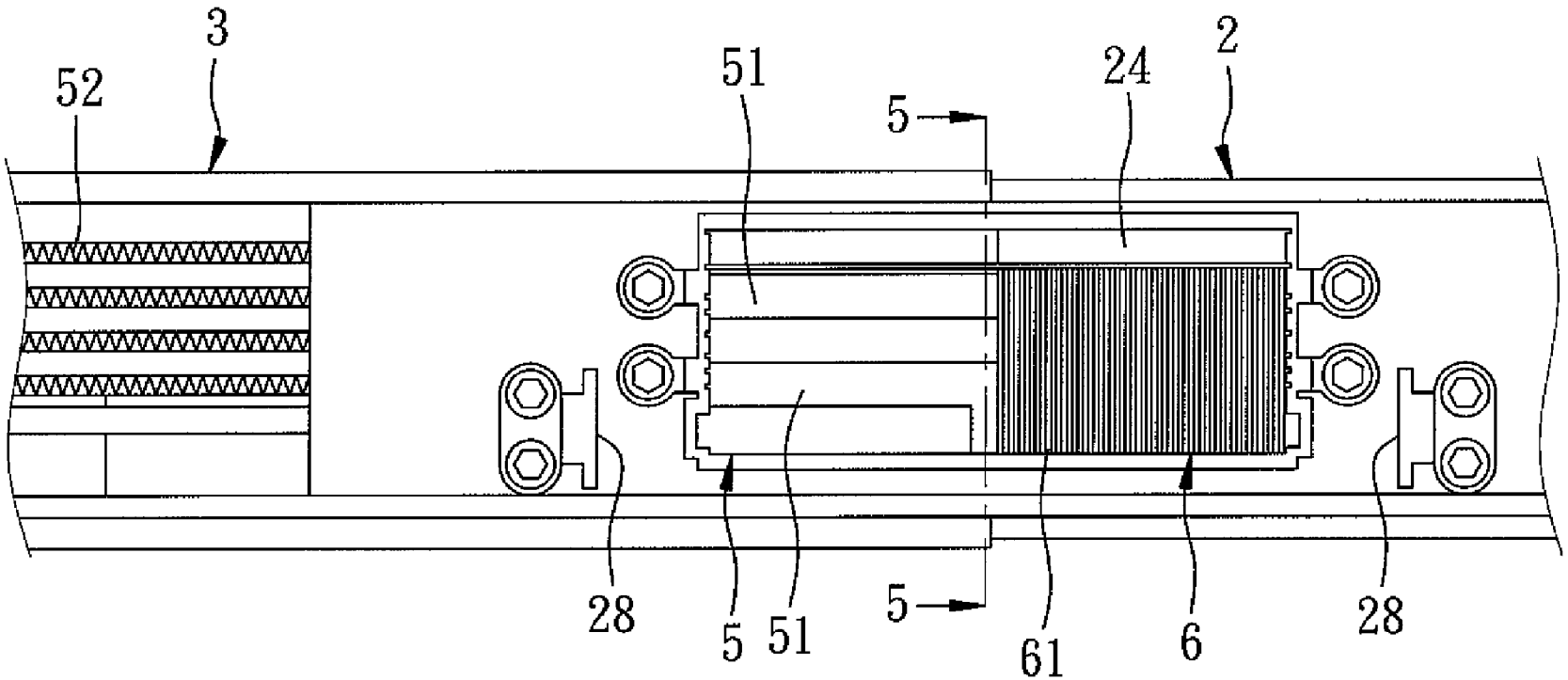
FIG. 4 is another fragmentary assembled side view of the preferred embodiment, illustrating a tray cover at an uncovering position.

As shown in FIGS. 4 and 5, after the loading of the nail strips 6 and the reassembly of the plate seat 41 of the first pusher unit 4 and the feeding tray 2, the first push plate 43 of the first pusher unit 4 is biased by the biasing components 45 to press downwardly against the nail tip portion 61 of the uppermost one of the nail strips 6 so as to push the nail strips 6 toward the nail path 23 in the transverse direction so that a lowermost one of the nail strips 6 is movable into the nail path 23 when the tray cover 3 is moved to the uncovering position. When the tray cover 3 is moved from the uncovering position to the covering position, the second push plates 51 are biased to push the nail strip 6 in the nail path 23 toward the nail outlet 29.

During the movement of the tray cover 3 relative to the feeding tray 2, the separating member 53 of the second pusher unit 5 is movable along with the tray cover 3 between a non-separating position (see FIGS. 4 and 5), where the tray cover 3 is disposed at the uncovering position and where movement of the lowermost one of the nail strips 6 from the loading space 24 into the nail path 23 is allowed, and a separating position (see FIGS. 6 and 7), where the tray cover 3 is disposed at the covering position. When the tray cover 3 is moved from the uncovering position to the covering position, the tapered end 531 of the separating member 53 moves into a portion of the nail path 23 located under the nail strips 6 so as to lift the remaining nail strips 6 away from the nail path 23, such that movement of a lowermost one of the remaining nail strips 6 from the loading space 24 in the feeding tray 2 into the nail path 23 is prevented.

When the nails of the nail strip 6 in the nail path 23 are exhausted, by moving the tray cover 3 relative to the feeding tray 2 to the uncovering position once again, the separating member 53 is back once again at the non-separating position to allow the lowermost one of the remaining nail strips 6 to move from the strip-receiving space portion 240 of the loading space 24 into the nail path 23. Afterward, the tray cover 3 is moved in the aforementioned manner along with the second pusher unit 5 to push the nail strip 6 in the nail path 23 toward the nail outlet 29.

In view of the above, the magazine of this invention can be loaded selectively with a plurality of or one nail strip 6 according to requirements during use. In addition, the loading space 24 can accommodate a relatively large number of nail strips 6 so as to facilitate use of the nail-driving power tool.

Compared to the above-mentioned prior art, the separating member 53 of the second pusher unit 5 has no keyways formed thereon, thereby being easier to be manufactured. Besides, there is no gap formed between the second push plate 51 and the separating member 53, and foreign particles will not be accumulated therebetween. Moreover, the separating member 53 can be moved easily along with the tray cover 3 from the separating position to the non-separating position without applying a force to overcome the biasing force of springs. Further, since the separating member 53 of the second pusher unit 5 can separate easily the nail strip 6 in the nail path 23 and the remaining nail strips 6 in the loading space 24 using the tapered end 531 when the tray cover 3 is disposed at the covering position, and since the first push plate 43 of the first pusher unit 4 is biased to press against the remaining nail strips 6 in the loading space 24, the second push plate 52 can push the nail strip 6 smoothly in the nail path 23 toward the nail outlet 29.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A magazine adapted for accommodating a plurality of stacked nail strips, each of which has a nail tip portion, said magazine comprising:

a feeding tray having a nail outlet formed at one end thereof, opposite first and second side surfaces, a nail path that is formed in said first side surface and that is sized to allow passage of only one of the nail strips therethrough at a time, and a loading space that extends therethrough in a transverse direction transverse to said nail path, that has a lower end in spatial communication with said nail path, and that is adapted for accommodating the nail strips;

a tray cover coupled slidably to said feeding tray and movable relative to said feeding tray between a covering position, where said nail path is covered by said tray cover, and an uncovering position, where said nail path is not covered by said tray cover;

a first pusher unit connected detachably to said feeding tray for covering an end of said loading space opposite to said nail path, and detachable from said feeding tray so as to allow the nail strips to be loaded into said loading space, said first pusher unit including a first push plate that is adapted to be biased to press downwardly against the nail tip portion of an uppermost one of the nail strips so as to push the nail strips toward said nail path in said transverse direction so that a lowermost one of the nail strips is movable into said nail path; and a second pusher unit disposed between said feeding tray and said tray cover, and including at least one second push plate that is adapted to be biased to push the lowermost one of the nail strips toward said nail outlet when the lowermost one of the nail strips is disposed in said nail path, and a separating member that is secured to said tray cover, that extends parallel to said nail path, and that is movable along with said tray cover between a separating position, where said tray cover is disposed in said covering position and where movement of the lowermost one of the nail strips from said loading space into said nail path is prevented, and a non-separating position, where said tray cover is disposed in said uncovering position and where movement of the lowermost one of the nail strips from said loading space into said nail path is allowed;

wherein said tray cover is slidable relative to said feeding tray so as to uncover at least one portion of said nail path, thereby permitting an additional nail strip to be placed into said nail path, after which said tray cover is movable to said covering position so that said second pusher plate contacts and pushes the additional nail strip toward said nail outlet;

wherein said first pusher unit further includes a plate seat coupled detachably to said feeding tray for covering said loading space, at least one rod extending perpendicularly from said first push plate through said plate seat, and at least one biasing component disposed between said first push plate and said plate seat and sleeved on said rod so as to bias said first push plate to press against the nail tip portion of the uppermost one of the nail strips; and wherein said plate seat of said first pusher unit includes two opposite resilient plates, and two barbed assembling components disposed respectively on said resilient plates, said feeding tray being formed with a pair of curved plates at said second side surface thereof that flank said loading space and that engage respectively and detachably said assembling components for coupling said plate seat and said feeding tray together, said curved plates extending from said second side surface toward each other.

2. The magazine as claimed in claim 1, wherein said feeding tray is formed with a surrounding wall defining said loading space, and having an inner wall surface that is formed with a plurality of opposed pairs of insert grooves located at different height positions, said first pusher unit further including a partition that is inserted removably into a selected one pair of said insert grooves to define a strip-receiving space portion such that the nail strips are accommodated fittingly within said strip-receiving space portion.

3. The magazine as claimed in claim 1, wherein said feeding tray includes a fill block disposed fixedly on said first side surface thereof, and a nail-limiting plate secured on said fill block and disposed parallel to said first side surface to define said nail path between said nail-limiting plate and said first side surface.

4. The magazine as claimed in claim 1, wherein said separating member of said second pusher unit is configured as a plate, and has a tapered end movable into a portion of said nail path located under the nail strips so as to lift the remaining nail strips away from said nail path when said tray cover is moved from said uncovering position to said covering position.

* * * * *